US009415983B2

(12) United States Patent
Dwire et al.

(10) Patent No.: US 9,415,983 B2
(45) Date of Patent: Aug. 16, 2016

(54) CRASH PREVENTION SYSTEM FOR A STORAGE AND RETRIEVAL MACHINE

(71) Applicant: Shamrock Foods Company, Phoenix, AZ (US)

(72) Inventors: Scott D. Dwire, Phoenix, AZ (US); Robert J. Waters, Phoenix, AZ (US)

(73) Assignee: Shamrock Foods Company, Phoenix, AZ (US)

( * ) Notice: Subject to any disclaimer, the term of this patent is extended or adjusted under 35 U.S.C. 154(b) by 0 days.

(21) Appl. No.: 14/068,362

(22) Filed: Oct. 31, 2013

(65) Prior Publication Data

US 2014/0172195 A1 Jun. 19, 2014

Related U.S. Application Data

(60) Provisional application No. 61/738,138, filed on Dec. 17, 2012.

(51) Int. Cl.

| | |
|---|---|
| ***G08G 9/02*** | (2006.01) |
| ***B66F 9/07*** | (2006.01) |
| ***B66F 17/00*** | (2006.01) |

(52) U.S. Cl.
CPC .. *B66F 9/07* (2013.01); *B66F 17/00* (2013.01)

(58) Field of Classification Search
None
See application file for complete search history.

(56) References Cited

U.S. PATENT DOCUMENTS

| | | | | | |
|---|---|---|---|---|---|
| 4,706,772 | A * | 11/1987 | Dawson | G05D 1/0242 | 180/167 |
| 5,509,774 | A * | 4/1996 | Yoo | B66F 9/18 | 187/237 |
| 5,970,433 | A * | 10/1999 | Oka | G01S 7/4811 | 250/559.13 |
| 2010/0106356 | A1* | 4/2010 | Trepagnier | G01S 17/023 | 701/25 |
| 2011/0166721 | A1* | 7/2011 | Castaneda | B62D 15/0265 | 701/2 |
| 2011/0218670 | A1* | 9/2011 | Bell | B66F 9/0755 | 700/215 |
| 2012/0236319 | A1* | 9/2012 | Gotou | G01S 7/497 | 356/614 |
| 2013/0197760 | A1* | 8/2013 | Castaneda | B66F 9/07581 | 701/41 |
| 2014/0074341 | A1* | 3/2014 | Weiss | B66F 9/063 | 701/25 |
| 2014/0133944 | A1* | 5/2014 | Pangrazio | B66F 9/0755 | 414/667 |

* cited by examiner

*Primary Examiner* — John R Olszewski
*Assistant Examiner* — Jess Whittington
(74) *Attorney, Agent, or Firm* — Polsinelli PC

(57) ABSTRACT

A crash prevention system mounted to the crane mast for a storage and retrieval machine having a rotating sensor apparatus for forming a circular detection pattern that detects an obstruction along the entire front or back of the crane mast is disclosed. A processor in operative communication with the rotating sensor apparatus generates a fault condition that terminates the movement of the storage and retrieval machine and prevents contact with the obstruction.

18 Claims, 13 Drawing Sheets

Lower Mounting Plate - Side

Lower Mounting Plate - Front

Lower Mounting Plate - Rear Isometric

Lower Mounting Plate - Top

Rope Guide - Isometric (116)

Rope Guide Assembly

CRASH PREVENTION SYSTEM FOR A STORAGE AND RETRIEVAL MACHINE

CROSS-REFERENCE TO RELATED APPLICATIONS

This application claims benefit to U.S. Provisional Patent Application Ser. No. 61/738,138 filed on Dec. 17, 2012, and is herein incorporated by reference it its entirety.

FIELD

The present document relates generally to a crash prevention system and in particular to a laser crash prevention system for a storage and retrieval machine.

BACKGROUND

In distribution centers, the use of automated Storage and Retrieval Machines (SRM) to handle palletized unit loads in a warehouse setting is well known. In a typical facility, the palletized unit loads are stored on one side of a lane by an SRM which typically has a multi-story crane that moves along each lane of the warehouse. The SRM includes an automated forklift apparatus that moves along the length of the crane and moves the various palletized unit loads around the warehouse. Typically, the SRM may store palletized unit loads on one side of a lane having multiple stories of storage space and then retrieved and positioned by the SRM on the opposite side of the lane for distribution of the palletized unit load. In this storage and distribution process, the SRM travels back and forth along the lane either storing or retrieving palletized unit loads from different levels of the warehouse. It is quite common for the pallet and/or the unit load to become repositioned or poorly staged during the storage and retrieval process due to mechanical machine failure or from human intervention in which the pallet or unit load is brought into direct interference with the travel path of the SRM, thereby resulting in the SRM colliding with the pallet or unit load during the normal travel cycle and operation of the SRM. Such collisions can cause severe damage to the SRM. As such, there is a need for a crash prevention system that prevents collisions between the SRM and the obstruction.

SUMMARY

In one embodiment, a vehicle, such as a storage and retrieval machine, includes a crash prevention system comprising a sensor apparatus for generating at least one laser beam that forms a detection pattern for detecting an obstruction in the path of the vehicle. A processor in operative communication with a controller generates a fault condition that terminates movement of the vehicle upon detection of the obstruction by the sensor apparatus. In some embodiments, the vehicle includes a crane mast in which the crash prevention system is mounted for providing a detection pattern that is parallel relative to the longitudinal axis of the crane mast and offset by a predetermined distance such that any obstruction originating from one side of the path is detected by the detection pattern generated by the sensor apparatus. A user interface is in operative communication with the processor for displaying data related to fault conditions and location of obstructions that resulted in the fault conditions.

In some embodiments, the crash prevention system may include a pair of sensor apparatuses with each sensor apparatus positioned on opposite sides of the vehicle for generating at least one laser beam for forming a detection pattern for detecting an obstruction originating from either side of the path being followed by the vehicle.

In some embodiments, the crash prevention system may include a single sensor apparatus arrangement or a dual sensor apparatus arrangement in which each sensor apparatus generates a pair of laser beams emitted at opposite directions, such as 180 degrees relative to each other, for forming a detection zone on either one side of the vehicle (e.g., single sensor arrangement) or both sides of the vehicle (e.g., dual sensor arrangement).

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding respective elements among the views of the drawings. The headings used in the figures should not be interpreted to limit the scope of the claims.

DETAILED DESCRIPTION

Figures 4, 5:
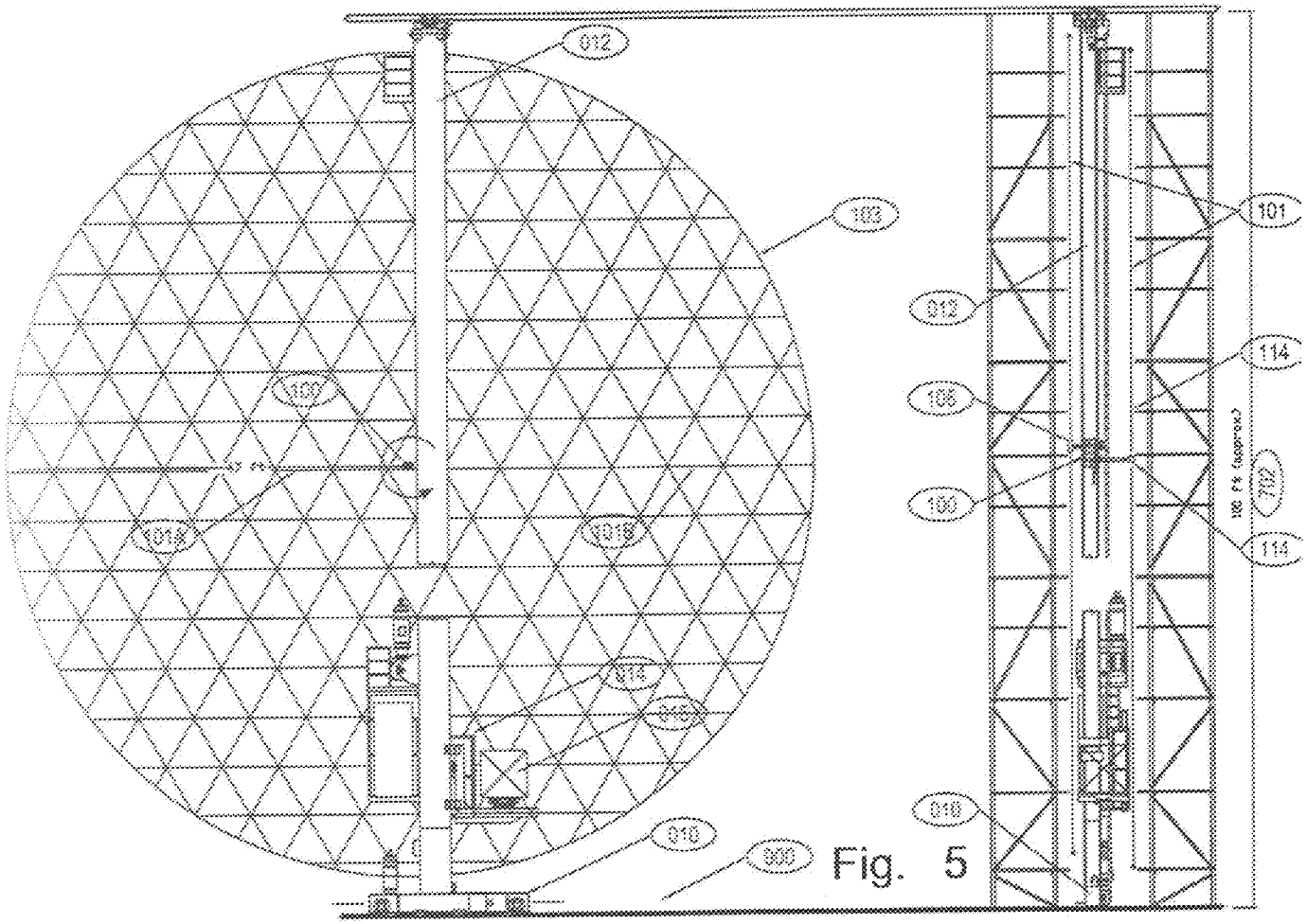
FIG. 4 is a side view of the storage and retrieval machine showing the operation of the crash prevention system including the detection zone established by the crash prevention system.
FIG. 5 is a front view of the storage and retrieval machine.

Referring to the drawings, an embodiment of a crash prevention system is illustrated and generally indicated as 100 in FIGS. 1-18 for use with a vehicle, such as a storage and retrieval machine 10, in detecting obstructions and terminating movement of the storage and retrieval machine 10 to prevent a collision with the detected obstruction. As shown in FIG. 4, the storage and retrieval machine 10 includes a crane mast 12 operatively engaged to an automated forklift apparatus 14 that is used to store and retrieve palletized unit loads 16 from various levels in a warehouse divided by different lanes. In one arrangement, a respective storage and retrieval machine 10 travels along a particular lane for conducting the storage and retrieval operation. In one embodiment, the crash prevention system 100 includes a housing 102 (FIG. 1) that is mounted to the crane mast 12 with a sensor apparatuses 106 extending from one side of the crane mast 12 for detecting obstructions originating from one side of the lane being traveled by the storage and retrieval machine 10. In other embodiments, the crash prevention system 100 includes at least one housing 102 mounted to the crane mast 12 with a pair of sensor apparatuses 106A and 106B for detecting obstructions originating from both sides of the lane. In some embodiments, detection of the obstruction causes a controller 110 to generate a fault condition that terminates movement of the storage and retrieval machine 10 and prevents contact with the obstruction, such as an improperly positioned pallet or unit load that extends into the lane and in the path being traveled by the storage and retrieval machine 10.

Figure 1:
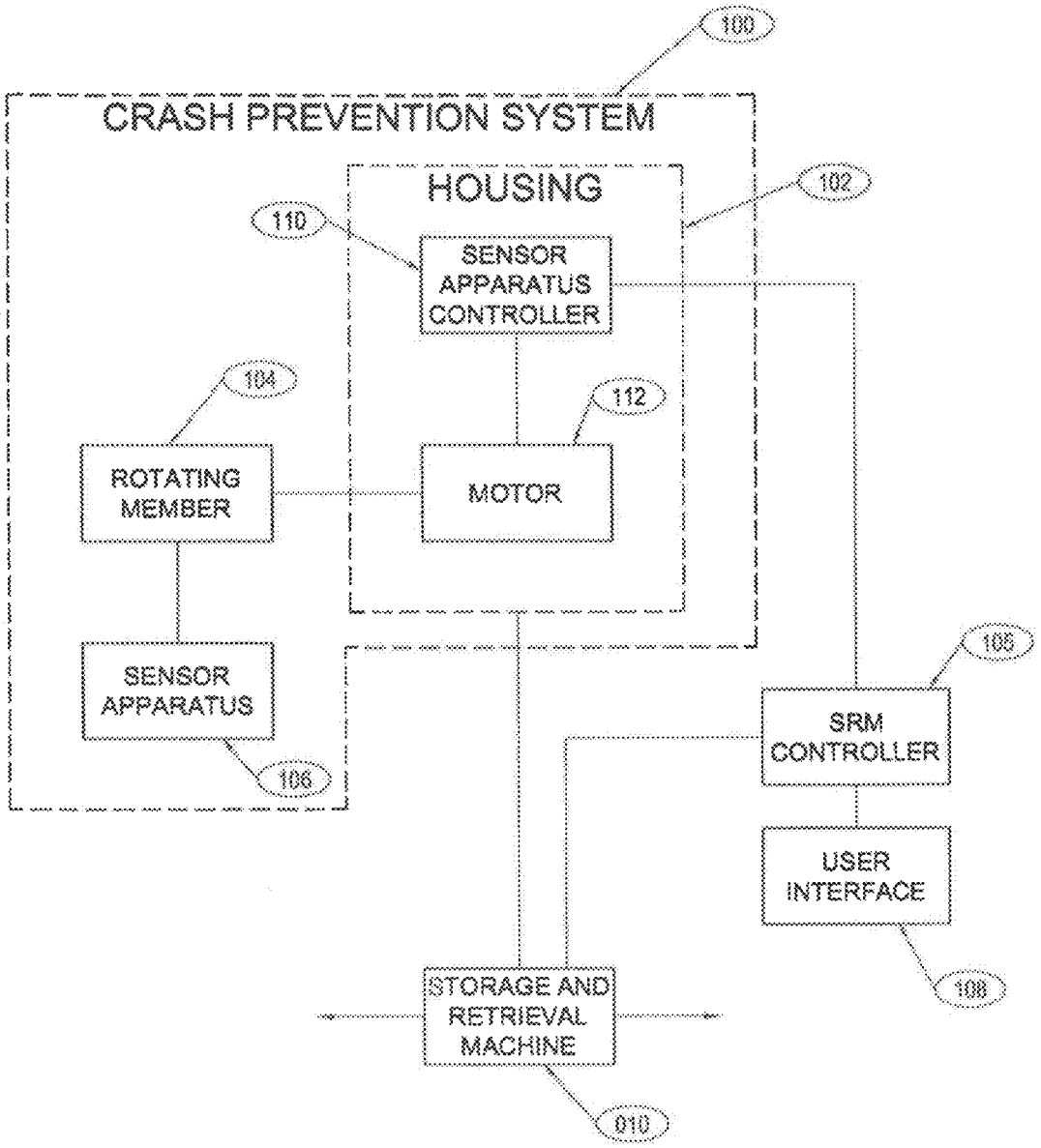
FIG. 1 is simplified block diagram of the crash prevention system and the storage and retrieval machine.

Referring to FIG. 1, the sensor apparatus controller 110 controls the operation of the crash prevention system 100 and is in operative communication with a motor 112 that is operatively engaged to a rotating member 104 for rotating a sensor apparatus 106 as shall be described in greater detail below. The sensor apparatus controller 110 may be in operative communication with a storage and retrieval machine (SRM) controller 105 that controls the operation of the storage and retrieval machine 10. The crash prevention system 100 further includes a user interface 108, such as a keyboard and display, in operative communication with the SRM controller 105 and sensor apparatus controller 110 for controlling and monitoring the operation of the crash prevention system 100. In addition, the SRM controller 105 may receive data from the sensor apparatus controller 110 related to the number of fault conditions that occur and the locations of the storage and retrieval machine 10 when the fault conditions have occurred.

Figure 2:
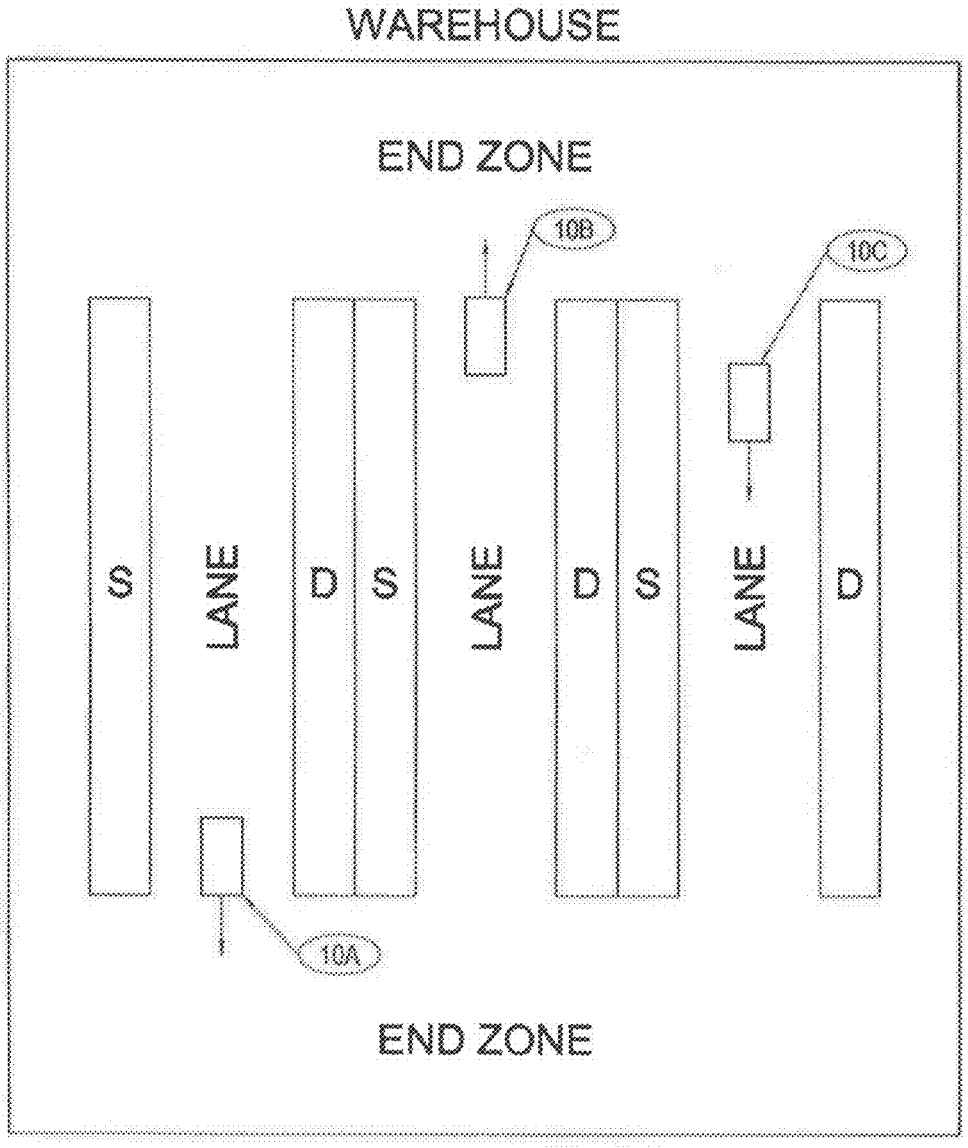
FIG. 2 is a simplified illustration showing the travel of the various storage and retrieval machines in a warehouse setting.

Referring to FIG. 2, in one arrangement a plurality of storage and retrieval machines, designated 10A-10C, may be deployed in a warehouse setting such that each of the storage and retrieval machines 10 travels along a designated lane when performing the storage and retrieval operation. In one particular arrangement, one side of the lane may be a storage side, designated s, for storing the palletized unit loads by the storage and retrieval machine 10, while the opposite side of the lane may be a distribution side, designated d, for unpacking and distributing the unit load by warehouse personnel when retrieved form the storage side by the storage and retrieval machine 10.

Figure 3:
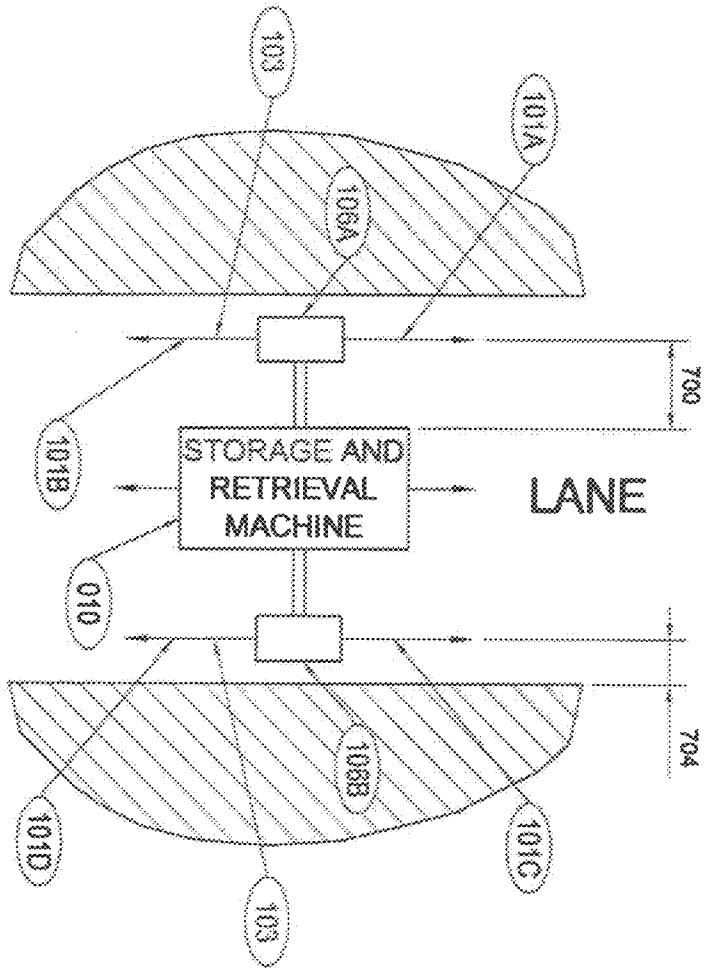
FIG. 3 is a simplified illustration of the storage and retrieval machine showing the operation of the crash prevention system
Figure 15:
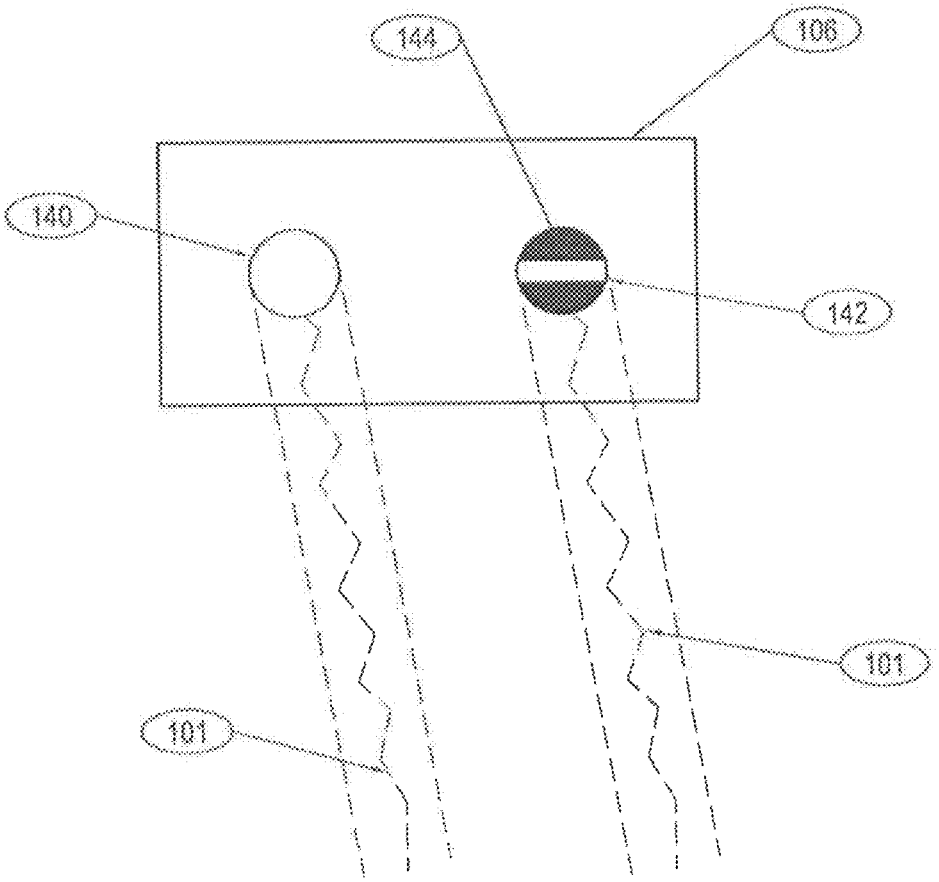
FIG. 15 is a front view of the sensor apparatus.

As noted above, the crash prevention system 100 generates a fault condition whenever an obstruction is detected that obstructs the line of travel of the storage and retrieval machine 10. As shown in FIGS. 3 and 4, in one embodiment a pair of sensor apparatuses, designated 106A and 106B, rotate a respective pair of laser beams 101A/B and 101C/D (FIG. 3) in a circular detection pattern 103 for detecting any obstructions originating from either side of the lane being traveled by the storage and retrieval machine 10. Referring to FIG. 15, for example, sensor apparatus 106 may include a transmitter 140 for transmitting at least one laser beam 101 and a receiver 142 for receiving the reflected laser beam 101 if an obstruction is detected. In some embodiments, the receiver 142 may include a slit 144 that allows the receiver 142 to receive only a portion of the reflected laser beam such that a narrower laser beam is detected by the receiver 142 when an obstruction has been detected by the sensor apparatus 106.

In one embodiment shown in FIG. 3, each sensor apparatus 106A and 106B generates a pair of oppositely emitted laser beams 101A/B and 101C/D that form the respective circular detection pattern 103 as each respective sensor apparatus 106A and 106B is rotated such that the circular detection pattern 103 is positioned in parallel orientation relative to the longitudinal axis 900 (FIG. 4) of the storage and retrieval machine 10 (e.g., path of travel) and is offset a predetermined distance from one side of the crane mast 12 of the storage and retrieval machine 10. For example, as shown In FIG. 3, in one embodiment the predetermined distance may be a length 700 of about 2 feet; however the length 700 may vary to accommodate lane width and/or the particular size and dimensions of the storage and retrieval machine 10 traveling down the lane. In addition, a length 704 of about 6 inches may used to establish a gap between the sides of the automated fork apparatus 14 on the storage and retrieval machine 10 and either side of the lane with respect to detecting potential obstructions.

In some embodiments, the detection pattern 103 may have an effective detection range of about 47 feet in either the forward or backward directions relative to the storage and retrieval machine. The detection range may be varied to extend or shorten the detection pattern 103 of the sensor apparatus 106.

Referring to FIG. 5, in one embodiment the housing 102 may be coupled to a mid point portion of the crane mast 12. For example, a storage and retrieval machine 10 having a crane mast 12 with a length 702 of about 100 feet should have the housing 102 mounted about 50 feet or the mid point position of length 702, especially if the detection range of the laser 101 is 47 feet in order to prevent false detections caused by the floor of the warehouse. In such an arrangement, the circular detection pattern 103 generated by the dual laser beams 101 is sufficiently wide enough to detect any obstruction that is in front or in back of the storage and retrieval machine 10. It was found that a detection range of 47 feet for the sensor apparatus 106 was sufficient to stop the storage and retrieval machine 10 moving at a speed of 7.6 feet per second to terminate all movement and prevent contact with the obstruction after detection.

Figure 6:
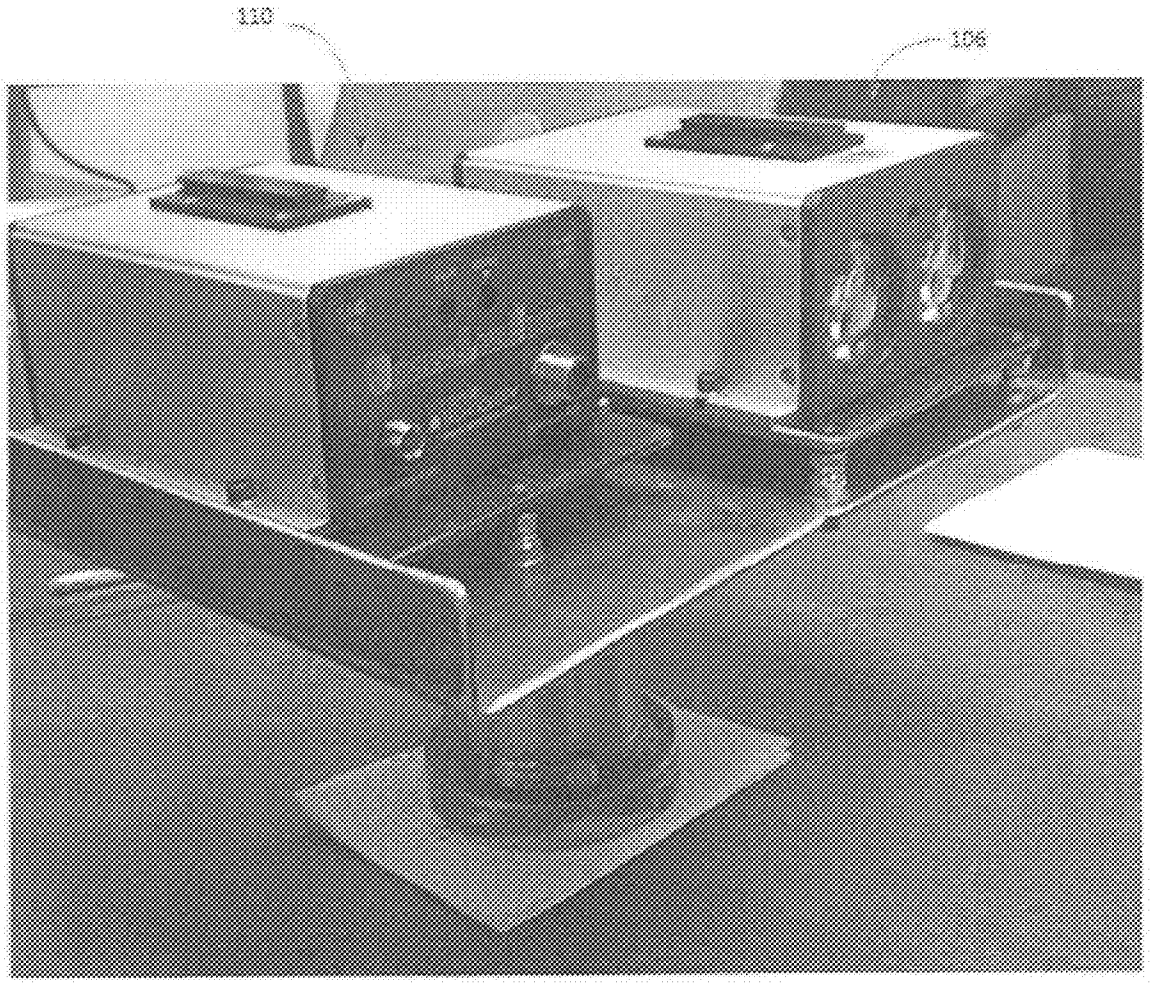
FIG. 6 is a picture showing the sensor apparatus for the crash prevention system.
Figure 7:
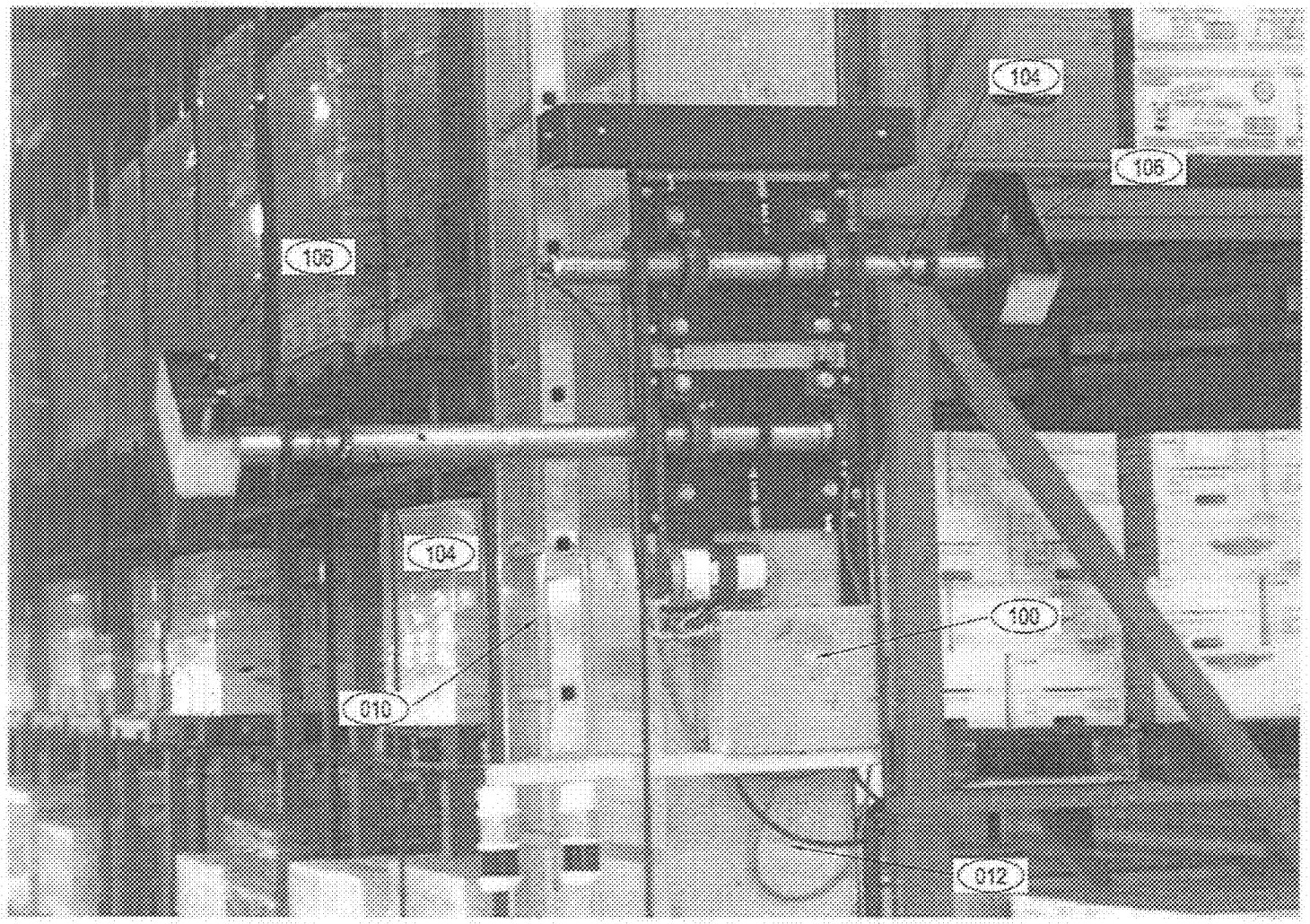
FIG. 7 is a picture showing the sensor apparatus engaged to the rotating member driven by a motor through a pulley arrangement.
Figure 8:
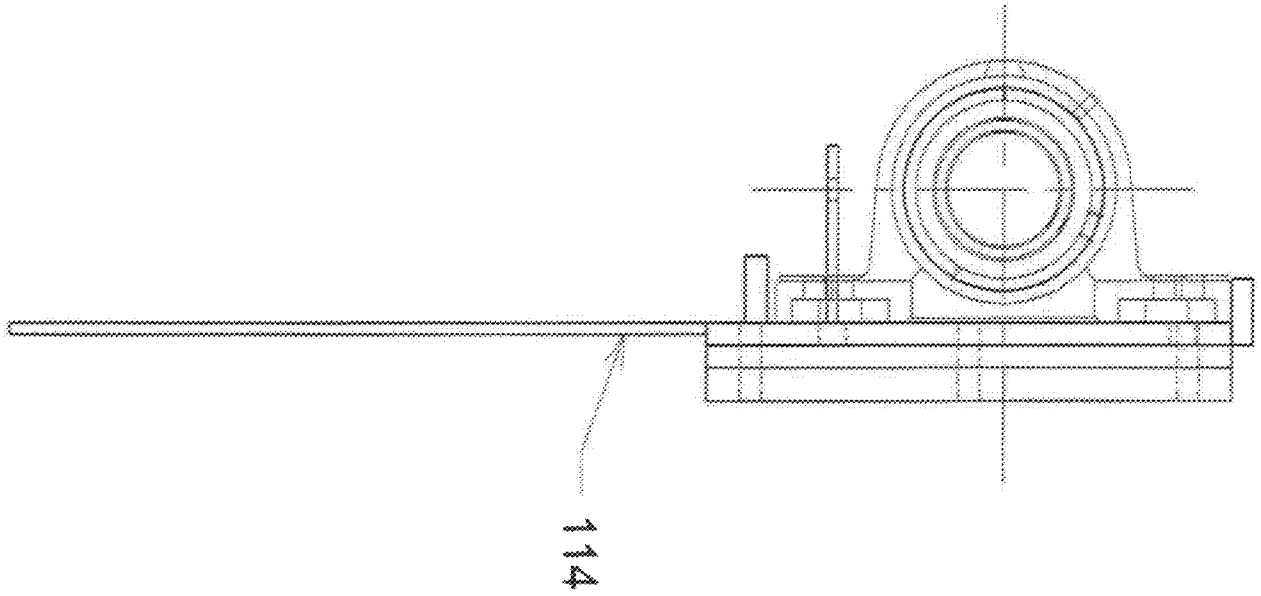
FIG. 8 is side view of a mounting plate used to engage the sensor apparatus to the storage and retrieval machine.
Figure 9:
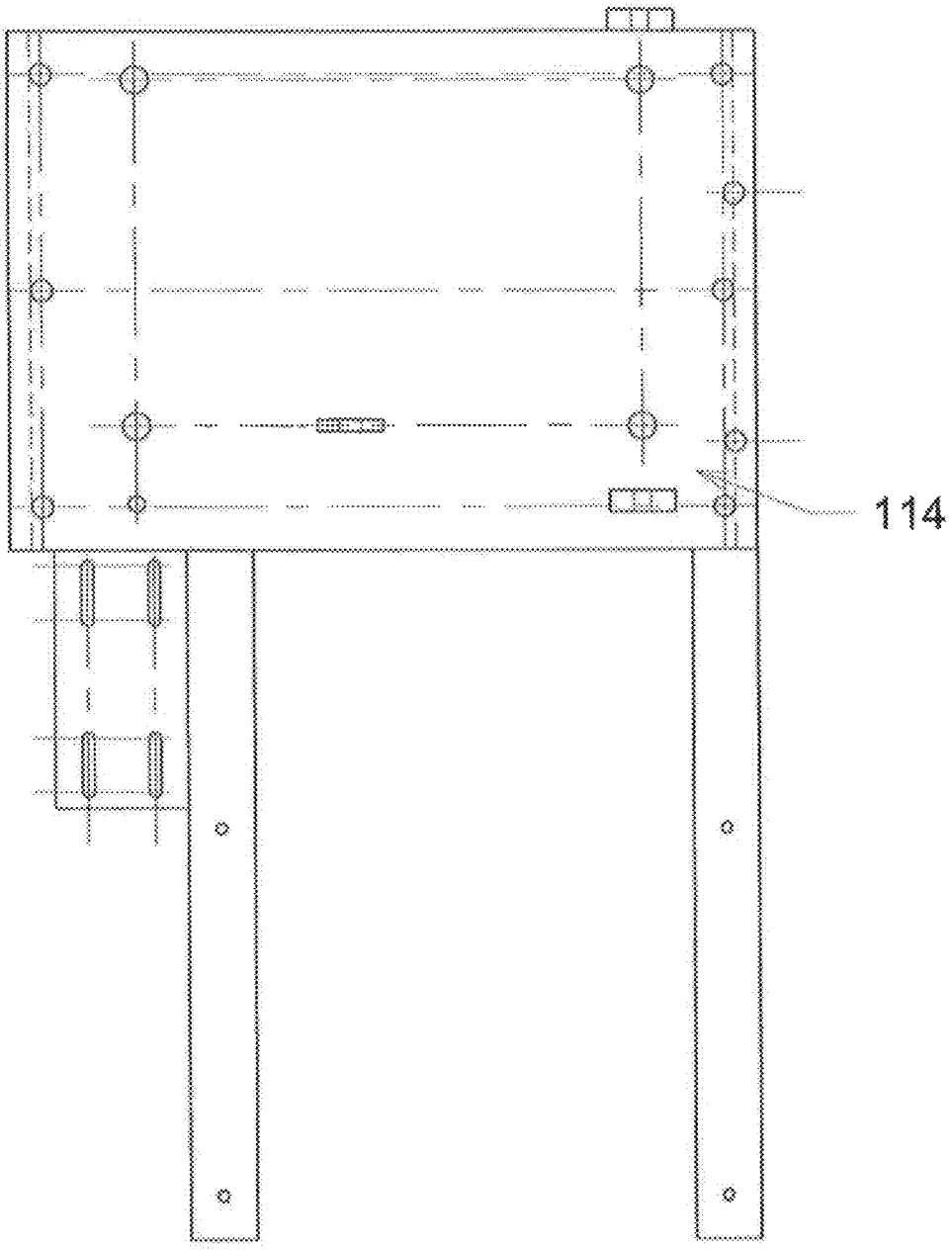
FIG. 9 is a front view of the mounting plate.
Figure 11:
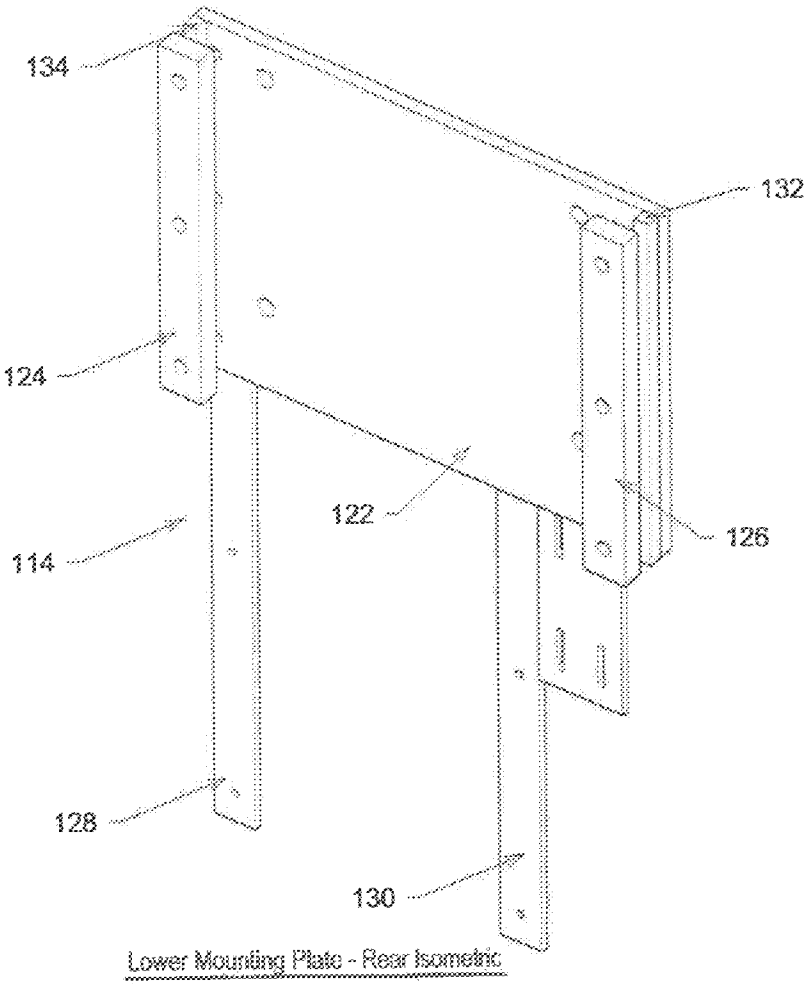
FIG. 11 is an isometric view of the mounting plate.
Figure 10:
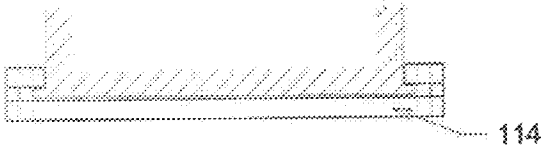
FIG. 10 is a top view of the mounting plate.

As shown in FIGS. 6 and 7, the sensor apparatus 106 is coupled to a rotating member 104 that rotates the sensor apparatus 106 about a longitudinal axis 902 defined by the rotating member 104. In one embodiment, the controller 110 causes the motor 112 to rotate the sensor apparatus 106 at approximately 23 RPM to generate the circular detection pattern 103 formed by the rotation of dual laser beams 101 shown in FIG. 4. As shown, the action of the motor 112 rotates the rotating member 104 at a rate controlled by the controller 110 through a pulley system operatively engaged between the motor 112 and the rotating member 104. In one embodiment, a cam operation occurs with the rotation of the sensor apparatus 106 such that rotation of the sensor apparatus 106 through a particular range of angles is noted by the sensor apparatus controller 110. When the storage and retrieval machine 10 is positioned at the end of the lane and proximate the end zone of the warehouse (FIG. 2), the circular detection pattern 103 will detect the presence of structural elements, such as stairs and aisles, located at the end of the warehouse; however, the sensor apparatus controller 110 is programmed to ignore the detection of any such structural elements at that particular range of angles during the cam operation by the sensor apparatus 106 when the storage and retrieval machine 10 is located proximate the end zone area of the lane. Otherwise, the processor 105 will generate a fault condition upon detection of the obstruction that will terminate the movement of the storage and retrieval machine 10. Once the obstruction is removed, the software is reset for allowing the continued operation of the storage and retrieval machine 10.

Referring to FIGS. 8-11, the housing 102 may be coupled to the crane mast 12 using a mounting plate 114. In one embodiment, the mounting plate 114 includes first and second clamping bars 124 and 126 engaged to either side of a mounting plate body 122. When engaged to the mounting plate body 122, the first and second clamping bars 124 and 126 form a recess with the mounting plate body 122 configured to engage a portion of the crane mast 12 such that the mounting plate 114 engages the housing 102 to the crane mast 12. In addition, first and second posts 128 and 130 extend outwardly downward from the mounting plate body 122. The first and second posts 128 and 130 are engaged to the housing 102 to provide a supporting mechanism for the sensor apparatus controller 110 and the associated electrical components in operative communication with the sensor apparatus motor 112, sensor apparatus 106, and SRM controller 105.

Figure 12:
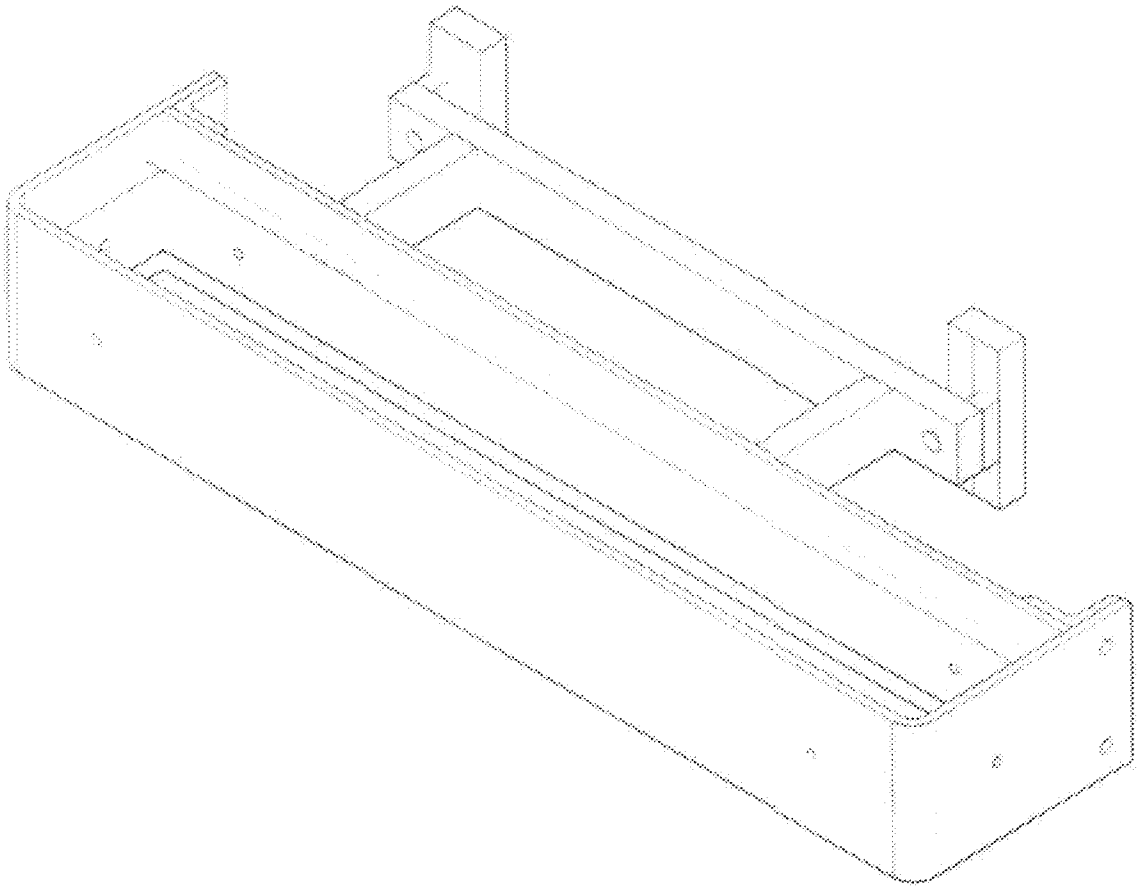
FIG. 12 is an isometric view of a rope guide.
Figure 13:
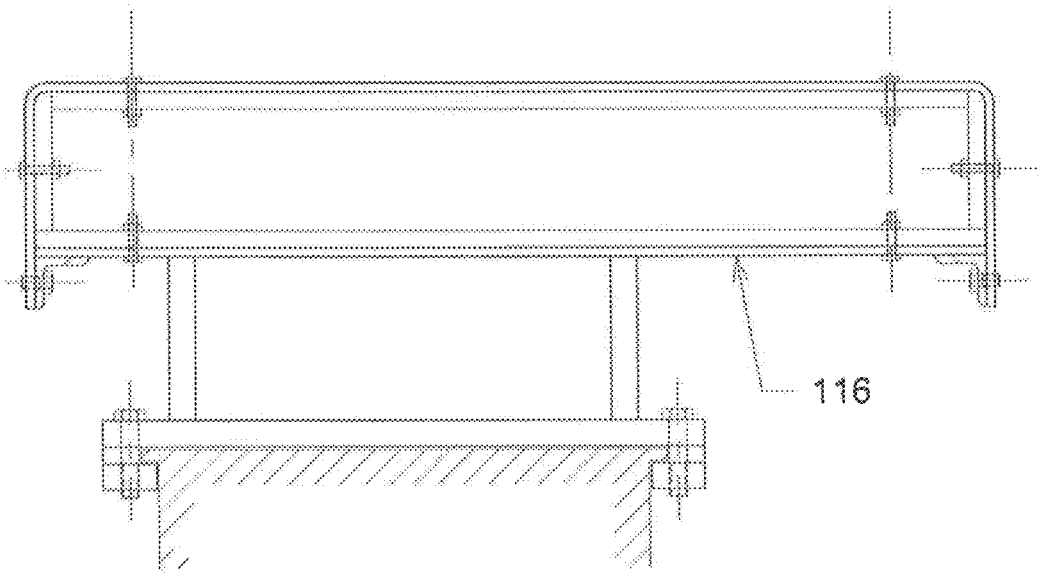
FIG. 13 is a top view of the rope guide engaged to the mounting plate.

Referring to FIGS. 12 and 13, a rope guide 116 may also be coupled to the crane mast 12 as part of the assembly that engages the housing 102 to the crane mast 12. The rope guide 116 prevents the wire ropes of the storage and retrieval machine 10 from interfering with the housing 102.

Figure 14:
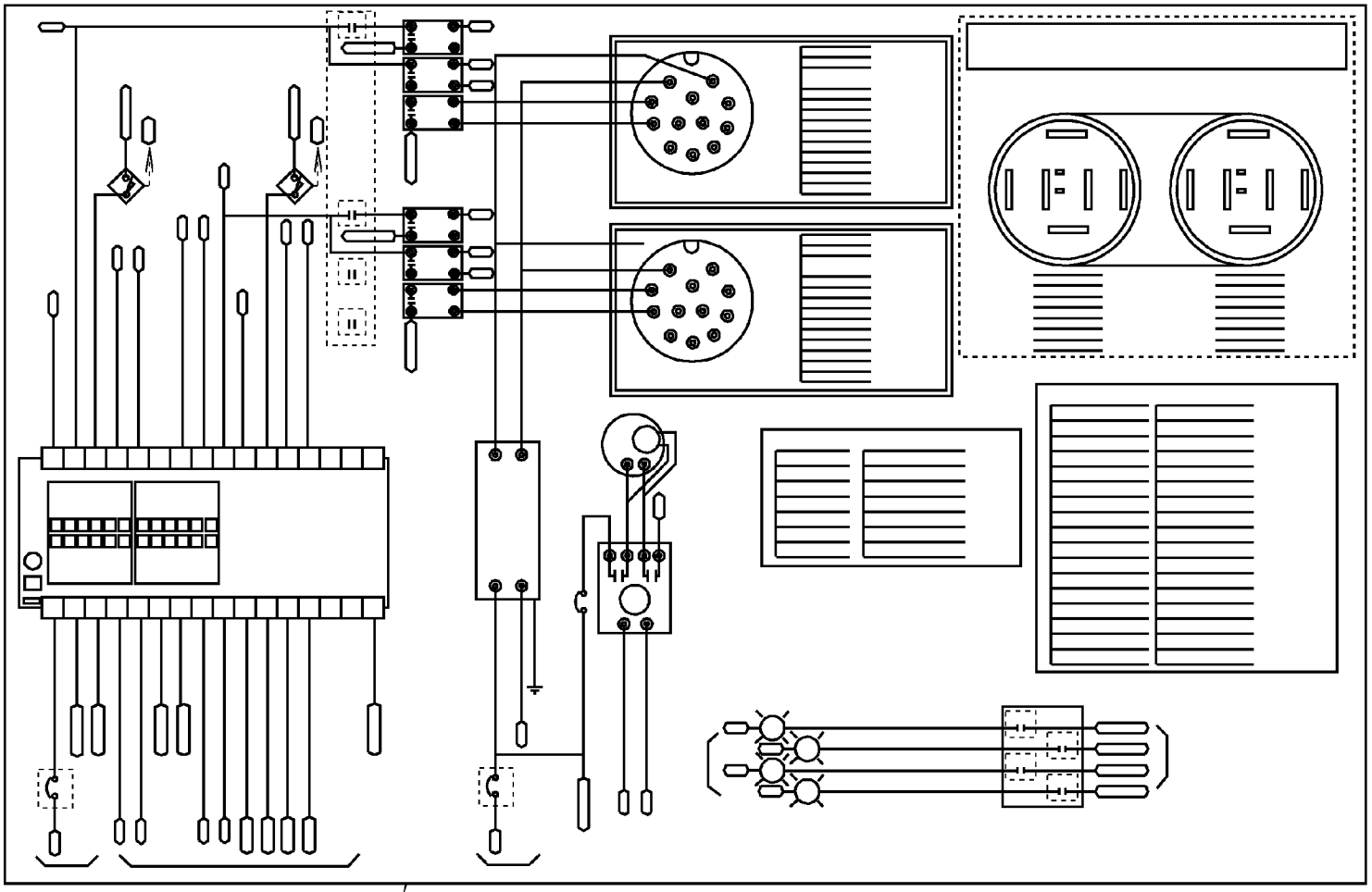
FIG. 14 is a simplified illustration of the sensor apparatus.

As shown in FIG. 14, the crash prevention system 100 further includes a slip ring 118 in which control connections may be passed through. In one embodiment, the slip ring 118 may be a Mertac Model 630. FIG. 14 further illustrates the control connections and other electrical circuits and components of the crash prevention system 100.

In some embodiments, the user interface 108 provides information related to the operation and monitoring of the crash prevention system 100, such as the number faults that have occurred as well as the times that these faults happened and the locations that the faults occurred. However, other types of information may be displayed by the user interface 108, such as the present location of the storage and retrieval machines 10A, 10B and 10C, within the facility or instructions to a storage and retrieval of particular palletized loads.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A crash prevention system for operative engagement with a vehicle for storage and retrieval comprising:
- a crane mast extending vertically from the vehicle;
- a first motor in operative engagement with a first rotating shaft;
- a second motor in operative engagement with a second rotating shaft;
- a first sensor apparatus engaged to the first rotating shaft for rotating the first sensor apparatus, the first sensor apparatus comprising:
  - a first transmitter for transmitting at least one laser beam; and
  - a first receiver for receiving a first reflected laser beam; and
- a second sensor apparatus engaged to the second rotating shaft for rotating the second sensor apparatus, the second sensor apparatus comprising:
  - a second transmitter for transmitting at least one laser beam; and
  - a second receiver for receiving a second reflected laser beam,
- wherein the vehicle has a longitudinal axis, wherein the first and second sensor apparatuses are in parallel orientation relative to the longitudinal axis of the vehicle, and wherein detection of either the first or second reflected laser beams generates a fault condition that terminates movement of the vehicle;
- wherein the fault condition that terminates the movement of the vehicle can be created when an object is detected in a path of the vehicle by the first reflected laser beam or the second reflected laser beam;
- wherein the first sensor apparatus and the second sensor apparatus extend horizontally from opposing lateral sides of the crane mast and the first rotating shaft and the second rotating shaft rotate in a vertical direction,
- wherein the first sensor apparatus and the second sensor apparatus are oriented a distance from the crane mast.

2. The crash prevention system of claim 1, further comprising:
- a first and second sensor apparatus controllers in operative communication with the first and second motors, respectively, for controlling operation of the first and second motors.

3. The crash prevention system of claim 1, further comprising:
- a first and second processors in operative communication with the first and second sensor apparatuses, respectively, for receiving data from the first and second sensor apparatuses, wherein the first and second processors generate the fault condition that terminates movement of the vehicle.

4. The crash prevention system of claim 1, wherein first and second sensor apparatuses generate a circular detection pattern.

5. The crash prevention system of claim 1, further comprising:
- at least one housing for mounting the first and second sensor apparatuses, wherein the at least one crane mast is configured for mounting the at least one housing for detecting any obstructions along a path of the at least one crane mast by the first or second sensor apparatuses.

6. A method of crash prevention for a storage and retrieval vehicle comprising:
- providing a crane mast extending vertically from the vehicle and a first rotating shaft and a second rotating shaft extending horizontally from opposing lateral sides of the vehicle;
- a. rotating the first rotating shaft and a first sensor apparatus coupled to the first rotating shaft in a vertical direction using a first motor operatively engaged with the first sensor apparatus, wherein a processor is operatively connected to the first sensor apparatus,
- b. rotating the second rotating shaft and a second sensor apparatus coupled to the second rotating shaft in the vertical direction using a second motor operatively engaged with the second sensor apparatus, wherein the processor is operatively connected to the sensor apparatus,
- c. transmitting at least one laser beam from the first sensor apparatus or second sensor apparatus;
- d. detecting a reflected laser beam within a detection range; and
- e. repeating steps a.-d. until detection of a reflected laser beam at the first sensor apparatus or second sensor apparatus, wherein detection of an object in a path of the reflected laser beam generates a fault condition that terminates movement of the vehicle,
- wherein the first sensor apparatus and the second sensor apparatus extend from opposing lateral sides of the crane mast.

7. The method of crash prevention of claim 6, wherein the at least one laser beam is rotated in a 180° pattern.

8. The method of crash prevention of claim 6, wherein the processor generates the fault condition that terminates movement of the vehicle.

9. The method of crash prevention of claim 6, wherein a controller is in operative communication with of the first sensor apparatus for storing a location of predetermined structural elements.

10. The method of crash prevention of claim 9, wherein the reflected laser beam from the predetermined structural elements does not generate the fault condition.

11. A crash prevention system for operative engagement with a storage and retrieval vehicle comprising:

a crane mast extending vertically away from the vehicle;

a first rotatable sensor apparatus extending horizontally from a first lateral side of the crane mast via a first rotating shaft, the first rotatable sensor apparatus including a first transmitter for transmitting a first laser beam and a first receiver for receiving a first reflected laser beam; and a second rotatable sensor apparatus extending horizontally from a second lateral side of the crane mast via a second rotating shaft opposite the first lateral side of the crane mast, the second rotatable sensor apparatus including a second transmitter for transmitting a second laser beam and a second receiver for receiving a second reflected laser beam, wherein the first and second rotating shafts rotate in a vertical direction and detection of an object in a path of the first reflected laser beam or second reflected laser beam generates a fault condition that terminates movement of the vehicle.

12. The crash prevention system of claim 11, wherein the first laser beam is rotated in a 180° pattern.

13. The crash prevention system of claim 11, wherein a processor generates the fault condition that terminates movement of the vehicle.

14. The crash prevention system of claim 11, wherein a plurality of predetermined structural elements does not generate the fault condition.

15. The crash prevention system of claim 11, wherein the first rotatable sensor apparatus is oriented offset from the second rotatable sensor apparatus with respect to the crane mast.

16. The crash prevention system of claim 11, further comprising:

a housing attached to the crane mast for mounting the first rotatable sensor apparatus and the second rotatable sensor apparatus; and a rope guide attached to the housing for preventing a wire from interfering with the housing, wherein the rope guide is coupled to the housing and the crane mast.

17. The crash prevention system of claim 11, wherein a detection pattern is generated by the first rotatable sensor apparatus and second rotatable sensor apparatus that is parallel relative to a longitudinal axis of the crane mast and offset by a predetermined distance such that any obstruction originating from one side of a path of the vehicle is detected by the detection pattern generated.

18. The crash prevention system of claim 11, further comprising a gap between the crane mast and first rotatable sensor apparatus due to the first rotating shaft being coupled between the first rotatable sensor apparatus and the crane mast.

* * * * *